US006693594B2

(12) United States Patent
Pankinaho et al.

(10) Patent No.: US 6,693,594 B2
(45) Date of Patent: Feb. 17, 2004

(54) OPTIMAL USE OF AN ELECTRICALLY TUNABLE MULTIBAND PLANAR ANTENNA

(75) Inventors: Ilkka Pankinaho, Paimio (FI); Juha-Pekka Louhos, Salo (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/114,591

(22) Filed: Apr. 1, 2002

(65) Prior Publication Data

US 2002/0180650 A1 Dec. 5, 2002

(30) Foreign Application Priority Data

Apr. 2, 2001 (FI) ..... 010682

(51) Int. Cl.[7] ..... H01Q 1/38

(52) U.S. Cl. ..... 343/700 MS; 343/702; 343/846

(58) Field of Search ..... 343/700 MS, 702, 343/876, 846, 848

(56) References Cited

U.S. PATENT DOCUMENTS

| | | | | |
|---|---|---|---|---|
| 5,764,190 A | | 6/1998 | Murch et al. | 343/702 |
| 5,777,581 A | | 7/1998 | Lilly et al. | 343/700 MS |
| 5,861,854 A | * | 1/1999 | Kawahata et al. | 343/702 |
| 5,926,139 A | | 7/1999 | Korisch | 343/702 |
| 5,943,016 A | | 8/1999 | Snyder, Jr. et al. | 343/700 MS |
| 6,072,434 A | | 6/2000 | Papatheodorou | 343/700 MS |
| 6,255,994 B1 | * | 7/2001 | Saito | 343/700 MS |
| 2001/0050635 A1 | | 12/2001 | Weinberger | 343/700 MS |
| 2001/0050636 A1 | | 12/2001 | Weinberger | 343/700 MS |

FOREIGN PATENT DOCUMENTS

| | | |
|---|---|---|
| DE | 10015583 A1 | 11/2000 |
| EP | 0856907 A1 | 8/1998 |
| EP | 0993070 A1 | 4/2000 |
| EP | 1014487 A1 | 6/2000 |
| EP | 1052722 A2 | 11/2000 |
| WO | WO 96/27219 | 9/1996 |
| WO | WO 99/30479 | 6/1999 |
| WO | WO 01/20718 A1 | 3/2001 |

OTHER PUBLICATIONS

* Front page of EP 1026774 A3, which corresponds to US Patent Publication No. 2001/0050635 A1 listed above.
* Front page of EP 1024553 A2, which corresponds to US Patent Publication No. 2001/0050636 A1 listed above.
"An Adaptive Microstrip Patch Antenna For Use in Portable Transceivers", Rostbakken et al., Vehicular Technology Conference, 1996, Mobile Technology For The Human Race, pp. 339–343.
Japanese patent document No. JP9307344—English translation of the Abstract enclosed.
Japanese patent document No. JP10224142—English translation of the abstract enclosed.

* cited by examiner

*Primary Examiner*—Tan Ho
(74) *Attorney, Agent, or Firm*—Perman & Green, LLP

(57) ABSTRACT

An antenna arrangement for mobile telecommunication devices comprises a planar radiating element (101), a ground plane (402) parallel to the planar radiating element (101) and means (301, 302, 303, 311, 312, 313, 411, 412, 413, 421, 422, 423, 431, 432, 433) for providing a grounding connection between the planar radiating element (101) and the ground plane (402). The means for providing a grounding connection between the planar radiating element (101) and the ground plane (402) comprise a number of Grounding connections (301/311, 302/312, 303/313, 411/412/413, 421/422/423, 431/432/433). A number of them is independently controllable between certain states. The state of each independently controllable grounding connection (301/311, 302/312, 303/313, 411/412/413, 421/422/423, 431/432/433) has an effect on certain operational frequency bands of the antenna arrangement.

21 Claims, 4 Drawing Sheets

OPTIMAL USE OF AN ELECTRICALLY TUNABLE MULTIBAND PLANAR ANTENNA

TECHNICAL FIELD

The invention concerns generally the technology of using small-sized planar multiband antennas in portable telecommunication devices. Especially the invention concerns the technology of tuning such multiband antennas so that their operational frequency bands can be controlled to match certain target values.

BACKGROUND OF THE INVENTION

An individual operational frequency band of an antenna arrangement, or just an antenna for short, is the continuous range of frequencies through which both the resonance characteristics of the resonant antenna element and the impedance matching between the resonant antenna element and the antenna port of the device coupled thereto are good enough to enable efficient transmission and/or reception. The criteria for both the resonance characteristics and the impedance matching are set in terms of attenuation in decibels, and these are typically laid down in system specifications. A multiband antenna means an antenna that has several operational frequency bands. An electrically tunable antenna is an antenna at least one operational frequency band of which can be repeatedly and controllably shifted along the frequency axis by applying an electric control signal to a certain part of the antenna.

A Planar Inverted-F Antenna, known also by its acronym PIFA, consists of an essentially planar radiating element, a ground plane that is essentially parallel to the radiating element, a feeding pin for coupling the radiating element to a duplexer or some other part of a radio device, and a grounding connection for coupling a certain point of the radiating element to the ground plane. The grounding connection is also called a short-circuit to ground or just a short. It is known that multiband PIFAs can be produced by making branches of different dimensions to the radiating element and by placing the feeding pin at a suitable location with respect to the branches. Another known way of producing multiband planar antennas is to use a number of independently fed planar radiating elements above a common ground plane. Prior art publications that disclose multiband planar antennas are known from e.g. EP1026774, EP1024552, U.S. Pat. Nos. 6,072,434, 5,926,139, EP0856907, U.S. Pat. No. 5,764,190 and WO9627219.

The public is continuously demanding a so-called world phone, meaning a single mobile telephone that could be used in all major mobile telephone networks around the world. A considerable hindrance to the task of developing such a phone is the fact that different mobile telephone systems use a variety of frequency ranges. On the other hand there is a clear trend towards smaller and smaller mobile telephones preferably with no protruding antennas. This means that in addition to having several operational frequency bands, the world phone antenna should be exceptionally compact in size in order to fit inside the covers of a modem mobile telephone. With the antenna technology of the priority date of this patent application, these requirements mean that a multiband planar antenna is about the only feasible solution.

Electrically tunable antennas are known from publications EP1014487, U.S. Pat. Nos. 5,943,016, 5,777,581, EP0993070, JP10224142 and JP9307344. The possibility of electrically tuning the antenna represents a remarkable advance towards a compact multiband antenna, but even these solutions leave open certain questions regarding how should the tuning control be implemented. Additionally there is the problem of how should the mobile telecommunications device react when it enters an area where a serving cellular radio system employs a different operational frequency band than the one onto which the antenna of the mobile device has currently been tuned.

SUMMARY OF THE INVENTION

It is an objective of the present invention to provide an antenna arrangement that has multiple operational frequency bands and tuning means for tuning these operational frequency bands to required locations on the frequency axis. It is a further objective of the invention that the antenna arrangement is compact in size and suitable for mass production. Another objective of the invention is to make it easy to adapt the tuning to situations where tuning should be changed for some reason. A yet another objective of the invention is to solve the problem that arises when the tunable antenna has been tuned to a different operational frequency band than that which a cellular radio system is currently using.

The objectives of the invention are achieved by providing a planar radiating element and multiple controllable grounding connections from the planar radiating element to an adjacent ground plane, and by dimensioning the electric characteristics of the grounding connections in a suitable way. The objectives are further achieved by arranging the control of the grounding connections in an advantageous way. A yet other aspect of achieving the objectives of the invention is to use a fixed wideband antenna for receiving.

The antenna arrangement according to the invention is characterised by the features recited in the independent patent claim directed to an antenna arrangement. Additionally the invention applies to a mobile telecommunications device the characteristic features of which are recited in the independent patent claim directed to a mobile telecommunications device.

Electrically tuning an antenna is not novel as such. It has been implemented e.g. by placing various conductive tuning elements in the vicinity of a radiating element and using electrically controllable semiconductor switches to open and close the connections between the tuning elements and the radiating element in a controlled manner.

According to the invention, it is not feasible to try to cover all required frequency ranges of a mobile telephone operable for reception and transmission in a multitude of mobile telephone systems by building an antenna so that it would inherently have operational frequency bands that would match each required frequency range. A multiband planar antenna can be constructed by using techniques known as such by making the planar radiating element to consist of at least two branches. A relatively simple but highly effective and reliable tuning arrangement then consists of a multitude of differently dimensioned and controllably switched grounding connections between the planar radiating element and an adjacent ground plane that can be opened and closed in various combinations.

In a preferred embodiment of the invention there are three controllably switched grounding connections relatively close to each other between the radiating element and the ground plane. The term "controllably switched" is interpreted widely so that it covers even a case where one of the connections is permanently in an "ON" state, i.e. does not actually need to have a switch at all. Each grounding connection represents a certain impedance between the (approximately common) coupling point at the radiating element and the ground potential. The impedance consists of the series resistance of the switching component, a tuning capacitance, a parasitic inductance of the switch package and the inductance of the grounding connection itself. Various combinations of carefully dimensioned impedances result in an antenna arrangement where certain states of the switches on the grounding connections correspond to matches between the operational frequency bands of the antenna arrangement and the frequency ranges of the required mobile telephone systems.

The problem of inherently narrow impedance bandwidth of multiband planar antennas is most advantageously circumvented so that the antenna according to the invention is only used in a mobile telephone (or more generally: in a mobile telecommunications apparatus) for transmitting. A separate antenna can be used for receiving. Such an arrangement loosens considerably the requirements for providing a high-quality versatile duplexer. Using separate antennas for transmission and reception also allows optimization to be made separately for both modes. The invention does not exclude using the antenna according to the invention for both transmission and reception, or even using two antennas according to the invention so that one is used for transmission and the other for reception.

An advantageous feature of the electrically tunable antenna arrangement according to the invention is that by using an appropriate feedback loop, the tuning can also be utilized for compensating for imperfections in antenna operation that are caused by the user's hand being placed too close to the radiating antenna element.

BRIEF DESCRIPTION OF DRAWINGS

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in depending claims are mutually freely combinable unless otherwise explicitly stated.

The following table summarizes the center frequency and transmission bandwidth requirements for a mobile communications device that could operate in the mobile telecommunications systems known as IS- (Interim Standard) 54, IS-136, IS-95, EGSM (Enhanced Global System for Mobile telecommunications), PCN (Personal Communications Network), PCS (Personal Communications System) and UMTS (Universal Mobile Telecommunications System).

| System | TX bandwidth (MHz) | center frequency (MHz) |
|---|---|---|
| IS-54, IS-136, IS-95 | 25 | 836.5 |
| EGSM | 35 | 897.5 |
| PCN | 75 | 1747.5 |
| PCS | 60 | 1880 |
| UMTS | 60 | 1950 |

These are encountered in combinations so that it is reasonable to require a "world phone" to be operable at any one time as either an EGSM+PCS phone, an IS-54+IS-136+IS-95+PCN phone or an UMTS phone. Speaking about a "phone" should not be construed to place limitations to the applicability of the invention: the invention is equally applicable to all mobile telecommunication devices that should be operable in at least two of said combinations, or even more generally in at least two mobile telecommunication environments that have different operational frequency ranges.

Figure 1:
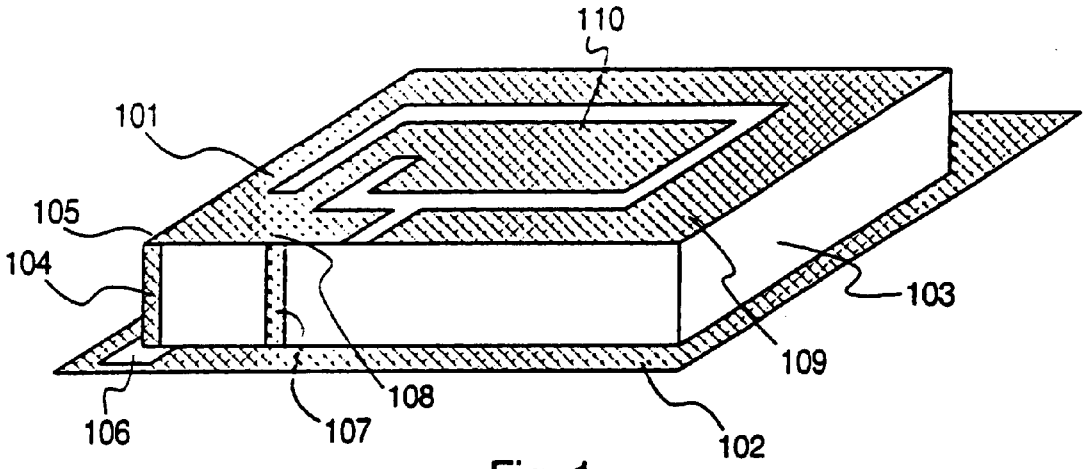
Fig. 1 PRIOR ART
FIG. 1 illustrates a known PIFA.

FIG. 1 illustrates a certain two-band PIFA, in which the form of the electrically conductive radiating element 101 corresponds roughly to that known from the mobile telephone model number 8210 manufactured and sold by Nokia Mobile Phones at the priority date of this patent application. The basis of the structure is a ground plane 102 that is most typically an essentially continuous conductive layer on one surface of a PCB. On top of the ground plane 102 there is placed a dielectric support block 103 that has two parallel planar faces. One of these is against the ground plane 102, while the other supports the radiating element 101. A feed connection 104 is coupled to a feeding point 105 of the radiating element 101. A non-conductive opening 106 in the ground plane 102 allows the lower end of the feed connection 104 to be coupled to the antenna port of a radio device (not shown). A ground connection strip 107, also known as the shorting post, couples a grounding point 108 of the radiating element 101 to the ground plane 102. One branch 109 of the radiating element 101 has an electric length that is remarkably greater than that of the other branch 110; the difference in electric length accounts for the different resonance frequencies of the branches, which in turn manifest themselves as the two operational frequency bands of the antenna.

Figure 2:
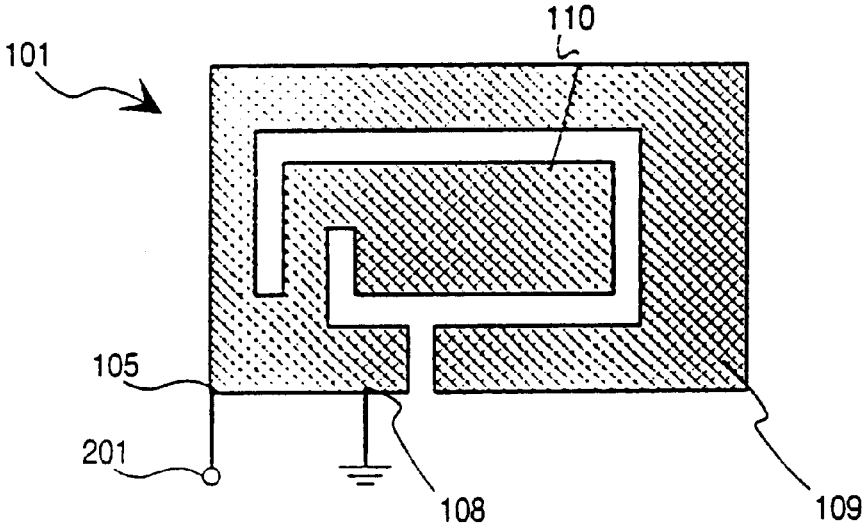
Fig. 2 PRIOR ART
FIG. 2 illustrates the known PIFA of FIG. 1 in more schematic view.

FIG. 2 is an even more schematic representation of the antenna of FIG. 1. The radiating element 101 is shown in planar projection with the form of its two branches 109 and 110 as well as the locations of the feeding point 105 and the grounding point easily perceivable. The antenna port 201 of a radio device is also schematically shown in FIG. 2.

Figure 3:
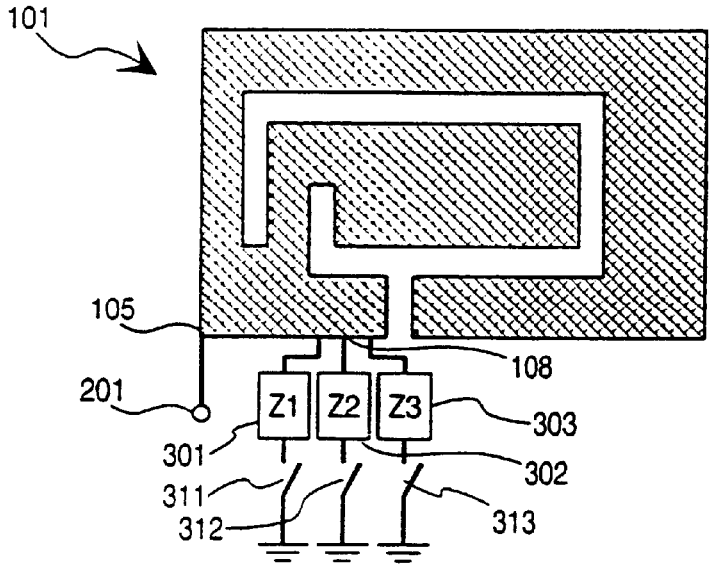
FIG. 3 illustrates an antenna according to an embodiment of the invention.

FIG. 3 illustrates the antenna of FIGS. 1 and 2 modified to accord with an embodiment of the present invention. In FIG. 3 there is again a radiating element 101 with a feeding point 105 and a grounding point 108. The feeding point 105 is coupled to an antenna port 201 of a radio device, which radio device itself is not shown in FIG. 3. However, the grounding point 108 is not directly coupled to ground. Instead, there are three alternative coupling paths between the grounding point 108 (or its vicinity) and the ground potential. Each of the alternative coupling paths has its own impedance 301, 302 or 303, the impedance values of these being designated in FIG. 3 as Z1, Z2 and Z3 respectively. In series with each impedance 301, 302 or 303 there is a controllable switch 311, 312 or 313 respectively. The antenna of FIG. 3 is tuned by closing and opening the switches 311, 312 and 313 in various combinations.

Figure 4:
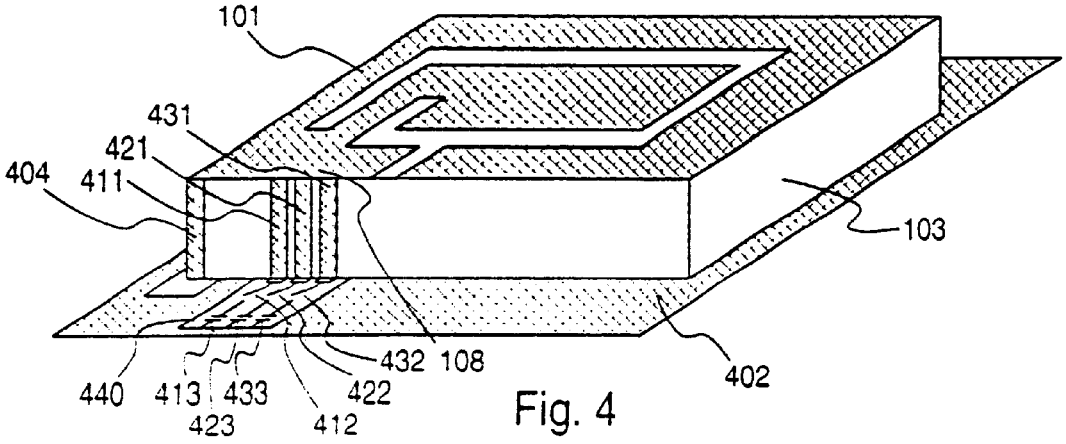
FIG. 4 illustrates the antenna of FIG. 3 in a partly more realistic view.

FIG. 4 illustrates a more reality-like implementation of the principle of FIG. 3, although also in FIG. 4 certain components are shown schematically in order to better illustrate their function. The radiating element 101 is supported at a nonzero distance from a ground plane 402 by a dielectric block 103 that has two parallel planar surfaces, one to be placed against the ground plane 402 and the other to support the radiating element 101. A feed connection 404 is galvanically coupled to the radiating element 101 at a certain feeding point.

A grounding point 108 (or the immediate vicinity thereof) of the radiating element 101 is coupled to the ground plane 402 through three parallel grounding connections. There are three parallel ground connection strips 411, 421 and 431 that run across a side of the dielectric block 103 that is perpendicular to the ground plane 402 and the radiating element 101. We may say that the ground plane 402 and the radiating element 101 are horizontal and the ground connection strips 411, 421 and 431 run across a vertical side of the dielectric block 103. Said directions refer only to the orientation shown in FIG. 4 and should not be construed to place limitations to the invention. The upper end of each of the ground connection strips 411, 421 and 431 is galvanically coupled to the radiating element 101 at the immediate vicinity of the grounding point 108, and the lower end of each of the ground connection strips 411, 421 and 431 is galvanically coupled to a contact pad of its own within an otherwise non-conductive opening 440 in the ground plane 402. In a typical implementation the ground plane 402 is a conductive layer on the surface of a PCB, so that at the non-conductive opening 440 the non-conductive base material of the PCB is visible.

Coupled in series with each of the ground connection strips 411, 421 and 431 is a controllable switch 412, 422 or 432 respectively. Further, coupled in series with each controllable switch 412, 422 and 432 is a tuning capacitance 413, 423 or 433 respectively. Each tuning capacitance includes a DC-blocking capacitance. Each series connection of a ground connection strip, a controllable switch and a tuning capacitance constitutes a connection from (the immediate vicinity of) the grounding point 108 to the ground plane 402. Each of these connections can be independently switched into an ON or OFF state by applying an appropriate control signal to the switch of the connection. The switches 412, 422 and 432 are either voltage controlled solid-state semiconductor switches such as FETs (Field Effect Transistors) or PHEMTs (Pseudomorphic High Electron Mobility Transistors), or voltage-controlled MEMS (Micro-Electro-Mechanical System) switches. Conventional GaAs FETs are not recommendable for the most demanding applications because they require a relatively high control voltage (>5V) and have less advantageous RF input power characteristics. The tuning capacitances 413, 423 and 433 can be chip capacitors or other structures known as such from the technology of miniaturized RF components.

At least some embodiments of the invention allow one of the switches 412, 422 and 432 to be permanently closed, i.e. replaced with a short circuit. Such a shorted switch may be accompanied with a tuning capacitance coupled in series therewith, or it may even be a direct galvanic connection to the ground potential.

Considering the impedance $Z_i$ between the grounding point 108 and the ground plane 402 represented by a single (i:th) grounding connection where the switch is in the ON state, it can be represented as $$Z_i=R_{s,i}+jX_i=R_{s,i}+j(\omega L_p+\omega L_{short,i}-1/(\omega C_{tune,i})), \quad (1)$$

where:

$R_{s,i}$=the series resistance of the i:th switch, j=the imaginary unit, $L_p$=the parasitic inductance of the switch package used to implement the switching function, $L_{short,i}$=the inductance of the i:th ground connection strip, $C_{tune,i}$=the capacitance value of the i:th tuning capacitance and $\omega=2\pi$ times frequency.

The resistance of each grounding connection is dominated by the resistance of the switch, so the resistance term in (1) is shown to consist of solely the series resistance of the switch. Specifically inductive components can be also added to each grounding connection, if it is regarded as advantageous to deliberately set the inductive reactance at some desired value. By choosing the tuning capacitance values and inductances properly it is possible to separately select the impedance value of each grounding connection. The fact that each ground connection strip is coupled to a slightly different point of the radiating element in the vicinity of the nominal grounding point also serves to slightly alter the effect of the state of each grounding connection to the resonance and impedance characteristics of the antenna arrangement.

First Exemplary Embodiment

Let us consider some exemplary cases. In the first case it is assumed that a first or "normal" state of the antenna arrangement refers to one where the middle switch (switch 422 in FIG. 4) is ON, i.e. closed, and the other two switches are OFF, i.e. open. Let us further assume that the impedance of the middle ground connection as well as the other properties of the antenna arrangement have been selected so that in said normal state the antenna can be used as an EGSM+PCS antenna. This means that in the normal state the antenna has operational frequency bands at 897.5 and 1880 MHz, with bandwidths of 35 and 60 MHz respectively.

If said exemplary antenna arrangement is to be used in a second state as an IS-54+IS-136+IS-95+PCN antenna, there should be achieved a change of approximately −7% in the location of each operational frequency band: the lower operational frequency band should be transferred to 836.5 MHz with an allowable reduction of bandwidth to 25 MHz, and the upper operational frequency band should be transferred to 1747.5 MHz, with a required extension of bandwidth to 75 MHz. There are at least two alternative ways of accomplishing the required changes. In a first alternative the right-hand switch (switch 432 in FIG. 4) is ON and the other two switches are OFF, and the impedance of the right-band connection (the one that includes switch 432 in FIG. 4) is more inductive than the impedance of the middle connection (the one that includes switch 422 in FIG. 4). In a second alternative both the middle and right-hand switches (switches 422 and 432 in FIG. 4) are ON and only the remaining left-hand switch (switch 412 in FIG. 4) is OFF. In this second alternative the combined impedance represented by the middle and right-hand connections must be more inductive than that represented by the middle connection alone. This means that in the second alternative the impedance of the right-hand connection must be predominantly capacitive.

If said exemplary antenna arrangement is to be used in a third state as a UMTS antenna, there should be achieved a change of approximately +4% in the location of the upper operational frequency band from its location in the normal state: it should be transferred to 1950 MHz, while keeping its bandwidth at 60 MHz. Again there are at least two alternatives: in said third state either the left-hand switch (switch 412 in FIG. 4) is ON and the other switches are OFF, with the impedance of the left-hand connection being smaller than or equal to that of the middle connection, or both the left-hand and middle switches are ON and the right-hand switch is OFF. Suitable impedance values for the last-mentioned alternative can be found by simulating and/or experimenting.

It is possible that certain problems arise in using an antenna according to the example described so far. For example, if closing the right-hand switch (switch 432 in FIG. 4) should provide a predominantly capacitive connection to ground and thereby transfer all operational frequency bands downwards by the same percentage (−7% in the example above), one must note that the capacitive reactance represented by a certain capacitance is a decreasing function of frequency. This means that the effect of such a predominantly capacitive connection to ground tends to be smaller on higher frequencies. Another fact to be considered is that it is always more difficult to cause an increase in the inductance of the overall grounding connection by parallel tuning strips than it is to cause decreases in inductance or increases in capacitance. A simple consequence of this fact is that it is easier to apply the teachings of this invention by tuning the operational frequency bands upwards from a certain predefined normal state than tuning them downwards from said normal state.

Second Exemplary Embodiment

The last-mentioned fact is a motivation for another exemplary embodiment of the invention where the IS-54+IS-136+IS-95+PCN state is selected as the first or normal state instead of the EGSM+PCS state that was the normal state in the first example. Let us assume that in the normal state of an antenna arrangement according to the second exemplary embodiment of the invention the right-hand switch (switch 432 in FIG. 4) is ON and the other two switches are OFF, and the characteristics of the antenna arrangement are selected so that in the normal state it has operational frequency bands at 836.5 and 1747.5 MHz, with bandwidths of 25 MHz and 75 MHz respectively.

A change to a second state which is an EGSM+PCS state requires a change of approximately +7% in the operational frequency bands: the band/bandwidth combinations of the second state should be 897.5/35 MHz and 1880/60 MHz. Again there are two alternative approaches. In the second state either only the middle switch (switch 422 in FIG. 4) is ON and the other two are OFF, or the middle and right-hand switches are ON while the left-hand switch is OFF. The total inductance of the grounding connection should be smaller than in the first state.

A change to a third state where the antenna could be used as a UMTS antenna would require an additional +4% upwards tuning from the second state. This is most easily accomplished by setting the left-hand switch (switch 412 in FIG. 4) ON. The resulting connection is the so-called dominating short, because it is physically closest to the feeding point. In order to accomplish the desired further upwards tuning, the inductance of the left-hand connection must be smaller than the inductance of the middle and right-hand connections. Depending on the dimensioning of the connections the third state may involve any combinations of ON and OFF states, including both ON and both OFF, of the middle and right-hand switches.

Third Exemplary Embodiment

In a third exemplary embodiment of the invention we depart slightly from the combinations of cellular systems assumed so far: now we assume that a first (normal) state corresponds to EGSM+PCN operation, a second state corresponds to IS-54+IS-136+IS-95+PCS operation and a third state continues to correspond to UMTS operation. We also utilize the fact that the impedance characteristics of the grounding connections depend on frequency: especially we assume that the left-hand connection (the one with strip 411, switch 412 and capacitance 413 in FIG. 4) is predominantly capacitive on the lower cellular system frequencies (those under 1000 MHz) and predominantly inductive on the higher cellular system frequencies (those between 1500 and 2000 MHz). Producing, a grounding connection that has such characteristics is considered to be within the capabilities of a person skilled in the art. Capacitance of a connection is a decreasing function of frequency.

In a first or normal state the antenna arrangement according to the third exemplary embodiment of the invention has thus operational frequency bands at 897.5 and 1747.5 MHz, with bandwidths of 35 and 75 MHz respectively. In said first or normal state the middle switch (switch 422 in FIG. 4) is ON and the other two switches are OFF. In a second state, which is now the IS-54+IS-136+IS-95+PCS state with bands/bandwidths 836.5/25 and 1880/60 MHz, the left-hand and middle switches 412 and 422 are ON and the remaining switch 432 is OFF. In a third (UMTS) state some remaining combination of switches ON or OFF is used, e.g. the outer switches 412 and 432 ON and the middle switch 422 OFF, or the left-hand and middle switches are ON and the right-hand switch is OFF.

Further Considerations

Throughout the preceding discussion we have assumed that there are exactly three independently controllable grounding connections and that these three grounding connections are galvanically coupled to a dual-branch planar radiating element at a point that is not clearly within either of the branches but located within the middle portion between the branches and relatively close to the feeding point. These assumptions have proved to result in practical embodiments of the invention, but they do not strictly limit the applicability of the invention. Firstly, it is clear that even with only two independently controllable grounding connections it is possible to realise four alternative operational states: one with both grounding connections in use, two with only one of the grounding connections in use, and one with neither of them in use. Each of these states may cause the operational frequency band(s) of an antenna arrangement to be shifted To different location(s) on the frequency axis. Note however that the PIFA principle requires there to be at least one grounding connection between the radiating element and the ground plane at all times.

Regarding a transition from a dual-band state (e.g. EGSM+PCS) where the antenna arrangement has a lower and an upper operational frequency band to a single-band state (e.g. UMTS) where the antenna arrangement has only a single operational frequency band that is higher on the frequency axis than the upper operational frequency band of the dual-band state, it is possible to use a controllable grounding connection that is galvanically coupled to the radiating element clearly within that branch the electric length of which is greater and that thus corresponds to the lower operational frequency band of the dual-band state. Setting such a controllable grounding connection ON short-circuits the antenna branch of the lower operational frequency band to ground, which means that it essentially stops functioning as a radiating antenna element, eliminating the lower operational frequency band altogether. Shorting the longer branch to ground also reduces the capacitive loading effect caused by the longer branch to the shorter branch, which causes a shift upwards in the resonance frequency of the shorter branch.

Placing one controllable grounding connection apart from others means, however, that the component count is increased, which is not advantageous: if the controllable shorting connections are located very close to each other as is schematically represented in FIG. 4, all required switching functions and capacitances can be implemented within a single integrated component. Additionally placing the parallel grounding connections relatively close to each other is advantageous from the manufacturing point of view. Producing three essentially equally dimensioned grounding connections at a certain physical location in the antenna arrangement is easy to accomplish so that good yield in the manufacturing process is maintained. Using connective strips that run across a side surface of a dielectric structural part serves the same purpose. It would naturally be possible to place the connections wide apart from each other or to use springs, pogo pins or the like to implement the connections, but such arrangements tend to have a negative effect on manufacturing yield and operational reliability.

Figure 5:
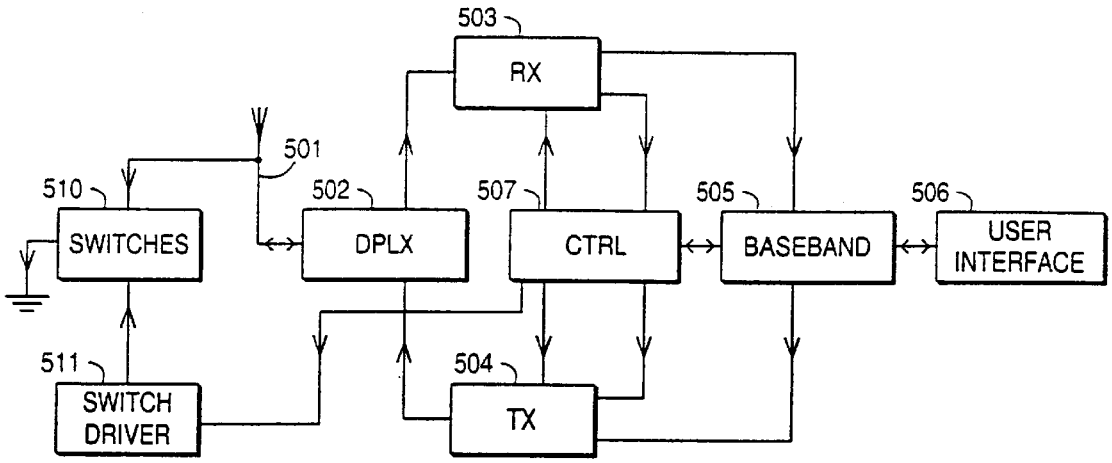
FIG. 5 illustrates a mobile terminal according to an embodiment of the invention.

FIG. 5 illustrates schematically certain parts of a mobile terminal according to an embodiment of the invention. An antenna 501 is coupled through a duplexing block 502 to a receiver block 503 and a transmitter block 504. The sink of payload data from the receiver block 503 and the source of payload data to the transmitter block 504 is a baseband block 505 which in turn is coupled to a user interface block 506 for communicating with a human or electronic user. A control block 507 receives control information from the receiver block 503 and transmits control information through the transmitter block 504. Additionally the control block 507 controls the operation of the blocks 503, 504 and 505.

In accordance with the invention, there is a switch block 510 that is arranged to controllably make certain connections between a radiating antenna element in the antenna 501 and the ground potential. A switch driver block 511 is arranged to provide the switch block 510 with the necessary control voltages that drive the switches in the switch block 510 either ON or OFF. The switch driver block 511 generates and applies these voltages as per instructions it receives from the control block 507.

Figure 6:
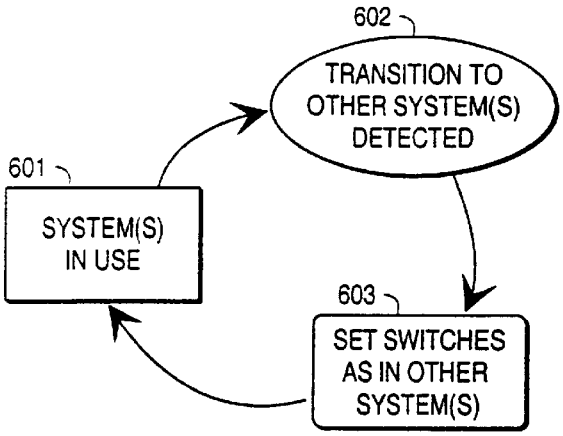
FIG. 6 illustrates a method according to an embodiment of the invention.

The control block 507 and the switch driver block 511 together implement a simple control loop that is illustrated in FIG. 6. For the majority of time said controlling blocks are in the static state 601 where the mobile terminal operates within certain cellular radio system(s) and the switches of block 510 are set accordingly. Every now and then there happens that the mobile terminal changes to operate within certain other cellular radio system(s). This is detected at the detection step 602. As a result of the detection the controlling blocks cooperate at the action step 603 to set the switches of block 510 into other states so that the antenna becomes tuned to the operational frequency range(s) of the new cellular radio system(s). When the switches have been set, the controlling blocks return to state 601 to wait for the next change of systems.

Using Separate TX And RX Antennas

Figure 7:
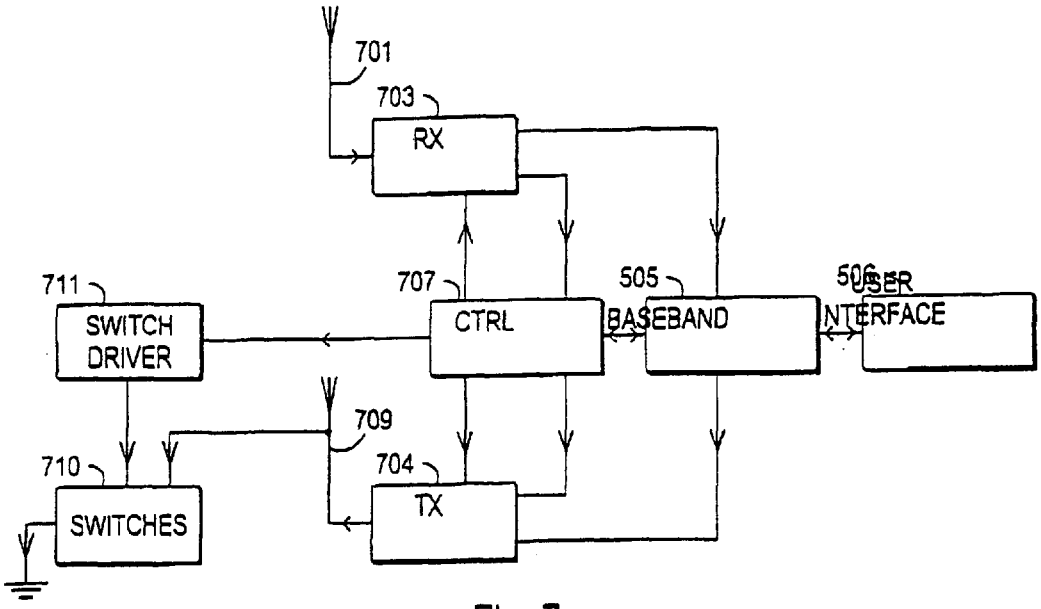
FIG. 7 illustrates a mobile terminal according to another embodiment of the invention.

FIG. 7 illustrates schematically certain parts of a mobile terminal according to another embodiment of the invention. An eye-catching feature of this embodiment is the use of separate antennas for transmission and reception. A reception antenna 701 is directly coupled to a receiver block 703, and a transmission antenna 709 is directly coupled to a transmitter block 704. Direct coupling means that there is no duplexer or antenna switch therebetween. From the transmission antenna 709 there is a coupling to a switch block 710 that includes switches driven by switch drivers located in a switch driver block 711. The control block 707 gives the switch driver block 711 the instructions about the required states of the switches at any given moment. Regarding pure selection of transmission frequency bands according to the cellular radio system to be used, we may assume that the control block 707 receives from the network certain instructions that cause the control block to instruct in turn the switch driver block 711.

Using a separate reception antenna with a fixed operational frequency range for reception means that the mobile terminal does not need to know anything about the available cellular radio systems when it is switched on. After having been switched on the mobile station starts receiving whatever signals there are currently coming from nearby base stations. Only after having received sufficient information about the cellular network systems currently available the mobile station needs to start transmitting, at which stage it has also received "instructions" or at least implicit information on the basis of which it can rune its own transmission antenna to the correct operational frequency band for transmitting.

Using the Electrical Tuning for Reducing Effects of User's Hand

Figure 8:
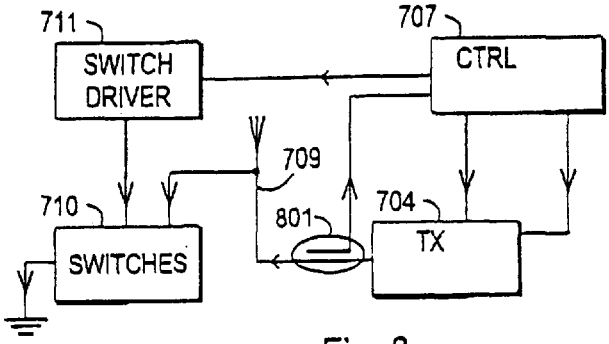
FIG. 8 illustrates the use of a feedback loop in association with the invention, and FIG. 8' illustrates a modification of FIG. 8.
Figure 8:
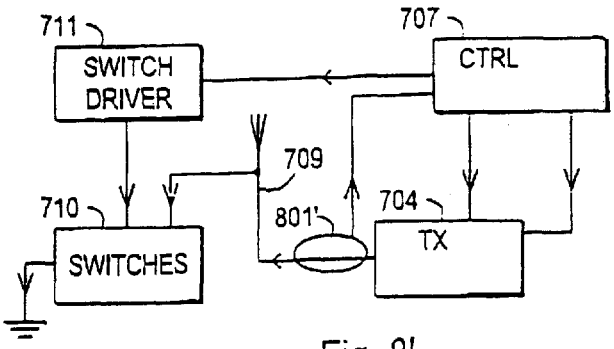

FIG. 8 shows a part of the components of FIG. 7 with the addition of a feature that can be used to enhance the versatility of an electrically tunable antenna. A directional coupler 801 in the transmission line between the transmitter block 704 and the transmission antenna 709 provides the control block 707 with measurement results that describe the signals passing between the transmitter block 704 and the transmission antenna 709. Such measurement results can be used, in a way known as such, to analyze, how good is the impedance matching between said two components. The designer of the mobile terminal aims at as good impedance matching as possible.

When a human user uses the mobile terminal, he most often holds it in his hand. Human tissue brought into the vicinity of an antenna has an effect on the electromagnetic characteristics of the antenna. Consequently the user's hand causes the impedance matching between the transmitter block 704 and the transmission antenna 709 to degrade from the optimum achieved by the designer.

Following the principle illustrated in FIG. 8 the control block 707 may utilize the measurement results it has obtained through the directional coupler 801 so that it keeps track of the dynamically changing impedance matching situation between the transmitter block 704 and the transmission antenna 709. If the control block detects that impedance matching has temporarily degraded because of e.g. the user's hand being unoptimally placed, it may try to correct the situation by instructing the switch driver block 711 to change the settings of at least one switch in the switch block 710. The effect of such a changed setting of switch(es)

comes immediately into the knowledge of the control block 707 through a changed reading in the measurement results it obtains through the directional coupler 801, so the control block 707 may react again if necessary. The directional coupler 801, the control block 707, the switch driver block 711 and the switch block 710 thus constitute a closed feedback-controlled loop. The correct way for the control block 707 and the switching arrangement to react to specific kinds of obtained measurement results is most appropriately found out through simulation and experimenting, and it can easily be stored in the form of machine-readable instructions into a program memory of the control block 707.

A directional coupler is not the only feasible means of obtaining measurement results that describe the dynamically changing impedance matching situation between the transmitter block 704 and the transmission antenna 709. As shown in FIG. 8', another "pickup" means include, but are not limited to, magnetic field loop antennas 801' implemented as conductive loops on the surface of a printed circuit board.

What is claimed is:

1. A mobile telecommunications device, comprising a radio transceiver having an antenna port and a control block, a ground plane constituting a local ground potential for the radio transceiver, a planar radiating element located parallel to the ground plane and coupled to the antenna port of the radio transceiver, a number of grounding connections between the planar radiating element and the ground plane, each of which grounding connections is independently controllable by the control block of the radio transceiver between certain states of conduction, wherein the state of conduction of each independently controllable grounding connection has an effect on certain operational frequency bands of the mobile telecommunications device;

wherein:

the planar radiating element comprises a first branch and a second branch, of which the electric length of said first branch is remarkably greater than that of said second branch, resulting in a lower operational frequency band and a higher operational frequency band, the control block of the radio transceiver is arranged to detect, based on information received from a cellular radio system, changes where the mobile telecommunications device moves from a first cellular radio system to a second cellular radio system, of which operation in said first cellular radio system involves a certain first radio frequency range and operation in said second cellular radio system involves a certain second radio frequency range that is different than said first radio frequency range, and the control block of the radio transceiver is equipped with means for altering the settings of said independently controllable grounding connections in response to detected changes when the mobile telecommunications device moves from a first cellular radio system to a second cellular radio system, so that altering the settings causes at least one of said lower and higher operational frequency bands to match a frequency range of said second cellular radio system.

2. A mobile telecommunications device according to claim 1, wherein the control block of the radio transceiver is arranged to detect dynamic changes in impedance matching between the antenna port of the radio transceiver and the planar radiating element, and the control block of the radio transceiver is further arranged to alter the settings of said independently controllable grounding connections in response to detected changes when the mobile telecommunications device moves from a first cellular radio system to a second cellular radio system.

3. A mobile telecommunications device according to claim 2, comprising a directional coupler located between the antenna port of the radio transceiver and the planar radiating element for providing the control block of the radio transceiver with measurement results that describe said impedance matching.

4. A mobile telecommunications device according to claim 2, comprising an internal magnetic field loop antenna for providing the control block of the radio transceiver with measurement results that describe said impedance matching.

5. A mobile telecommunications device according to claim 1, wherein the control block of the radio transceiver is arranged to receive from a cellular radio system information describing available cellular radio systems at the current location of the mobile telecommunications device, and the control block of the radio transceiver is further arranged to alter the settings of said independently controllable grounding connections in response to said information received from a cellular radio system.

6. A mobile telecommunications device according to claim 5, wherein the control block of the radio transceiver is additionally arranged to detect dynamic changes in impedance matching between the antenna port of the radio transceiver and the planar radiating element, and the control block of the radio transceiver is also arranged to alter the settings of said independently controllable grounding connections in response to detected changes when the mobile telecommunications device moves from a first cellular radio system to a second cellular radio system.

7. A mobile telecommunications device according to claim 1, wherein the radio transceiver has two antenna ports, which are a reception antenna port and a transmission antenna port, and the mobile telecommunications device comprises a reception antenna coupled to said reception antenna port and a transmission antenna coupled to said transmission antenna port, so that said planar radiating element is part of said transmission antenna.

8. A mobile telecommunications device according to claim 7, wherein said reception antenna has a fixed operational frequency band.

9. A mobile telecommunications device, comprising a radio transceiver having an antenna port and a control block, a ground plane constituting a local ground potential for the radio transceiver, a planar radiating element located parallel to the ground plane and coupled to the antenna port of the radio transceiver, a number of grounding connections between the planar radiating element and the ground plane, each of which grounding connections is independently controllable by the control block of the radio transceiver between certain states, wherein the state of each independently controllable grounding connection has an effect on certain operational frequency bands of the mobile telecommunications device;

wherein the control block of the radio transceiver is arranged to detect changes where the mobile telecommunications device moves from a first cellular radio system to a second cellular radio system, of which operation in said first cellular radio system involves a certain first radio frequency range and operation in said second cellular radio system involves a certain second radio frequency range that is different than said first radio frequency range, and the control block of the radio transceiver is further arranged to alter the settings of said independently controllable grounding connections in response to detected changes when the mobile telecommunications device moves from a first cellular radio system to a second cellular radio system, and an internal magnetic field loop antenna for providing the control block of the radio transceiver with measurement results that describe said impedance matching.

10. A mobile telecommunications device according to claim 9, wherein the control block of the radio transceiver is arranged to detect dynamic changes in impedance matching between the antenna port of the radio transceiver and the planar radiating element, and the control block of the radio transceiver is further arranged to alter the settings of said independently controllable grounding connections in response to detected changes of said kind.

11. A mobile telecommunications device according to claim 10, comprising a directional coupler located between the antenna port of the radio transceiver and the planar radiating element for providing the control block of the radio transceiver with measurement results that describe said impedance matching.

12. A mobile telecommunications device according to claim 9, wherein the control block of the radio transceiver is arranged to receive from a cellular radio system information describing available cellular radio systems at the current location of the mobile telecommunications device, and the control block of the radio transceiver is further arranged to alter the settings of said independently controllable grounding connections in response to said information received from a cellular radio system.

13. A mobile telecommunications device according to claim 12, wherein the control block of the radio transceiver is additionally arranged to detect dynamic changes in impedance matching between the antenna port of the radio transceiver and the planar radiating element, and the control block of the radio transceiver is also arranged to alter the settings of said independently controllable grounding connections in response to detected changes of said kind.

14. A mobile telecommunications device according to claim 9, wherein the radio transceiver has two antenna ports, which are a reception antenna port and a transmission antenna port, and the mobile telecommunications device further comprises a reception antenna coupled to said reception antenna port and a transmission antenna coupled to said transmission antenna port, so that said planar radiating element is part of said transmission antenna.

15. A mobile telecommunications device according to claim 14, wherein said reception antenna has a fixed operational frequency band.

16. A mobile telecommunications device, comprising a radio transceiver having an antenna port and a control block, a ground plane constituting a local ground potential for the radio transceiver, a planar radiating element located parallel to the ground plane and coupled to the antenna port of the radio tranceiver, a number of grounding connections between the planar radiating element and the ground plane, each of which grounding connections is independently controllable by the control block of the radio transceiver between certain states, wherein the state of each independently controllable grounding connection has an effect on certain operational frequency bands of the mobile telecommunications device;

wherein the control block of the radio transceiver is arranged to detect changes where the mobile telecommunications device moves from a first cellular radio system to a second cellular radio system, of which operation in said first cellular radio system involves a certain first radio frequency range and operation in said second cellular radio system involves a certain second radio frequency range that is different than said first radio frequency range, and the control block of the radio transceiver is further arranged to alter the settings of said independently controllable grounding connections in response to detected changes when the mobile telecommunications device moves from a first cellular radio system to a second cellular radio system, and wherein the radio transceiver has two antenna ports, which are a reception antenna port and a transmission antenna port, and the mobile telecommunications device comprises a reception antenna coupled to said reception antenna port and a transmission antenna coupled to said transmission antenna port, so that said planar radiating element is part of said transmission antenna.

17. A mobile telecommunications device according to claim 16, wherein the control block of the radio transceiver is arranged to detect dynamic changes in impedance matching between the antenna port of the radio transceiver and the planar radiating element, and the control block of the radio transceiver is further arranged to alter the settings of said independently controllable grounding connections in response to detected changes of said kind.

18. A mobile telecommunications device according to claim 17, comprising a directional coupler located between the antenna port of the radio transceiver and the planar radiating element for providing the control block of the radio transceiver with measurement results that describe said impedance matching.

19. A mobile telecommunications device according to claim 16, wherein the control block of the radio transceiver is arranged to receive from a cellular radio system information describing available cellular radio systems at the current location of the mobile telecommunications device, and the control block of the radio transceiver is further arranged to alter the settings of said independently controllable grounding connections in response to said information received from a cellular radio system.

20. A mobile telecommunications device according to claim 19, wherein the control block of the radio transceiver is additionally arranged to detect dynamic changes in impedance matching between the antenna port of the radio transceiver and the planar radiating element, and the control block of the radio transceiver is also arranged to alter the settings of said independently controllable grounding connections in response to detected changes of said kind.

21. A mobile telecommunications device according to claim 16, wherein said reception antenna has a fixed operational frequency band.

* * * * *